US005936338A

United States Patent [19]

Takahashi

[11] Patent Number: 5,936,338

[45] Date of Patent: Aug. 10, 1999

[54] COLOR DISPLAY SYSTEM UTILIZING DOUBLE QUADRUPOLE LENSES UNDER OPTIMAL CONTROL

[75] Inventor: Yoshiaki Takahashi, Chiba, Japan

[73] Assignees: Hitachi, Ltd., Tokyo; Hitachi Electronic Devices Co., Ltd., Mobara, both of Japan

[21] Appl. No.: 08/902,018

[22] Filed: Jul. 29, 1997

Related U.S. Application Data

[63] Continuation-in-part of application No. 08/560,010, Nov. 17, 1995, abandoned.

[30] Foreign Application Priority Data

Nov. 25, 1994 [JP] Japan ..... 2-291325

[51] Int. Cl.[6] ..... H01J 29/48

[52] U.S. Cl. ..... 313/414; 313/412; 313/449

[58] Field of Search ..... 313/414, 412, 313/413, 449, 453; 315/14, 15, 382

[56] References Cited

U.S. PATENT DOCUMENTS

| | | | |
|---|---|---|---|
| 4,728,859 | 3/1988 | Natsuhara et al. | 315/15 |
| 5,162,695 | 11/1992 | Shimona et al. | 313/414 |
| 5,404,071 | 4/1995 | Son | 313/414 |

FOREIGN PATENT DOCUMENTS

| | | | |
|---|---|---|---|
| 0332469 | 9/1989 | European Pat. Off. | H01J 29/50 |
| 0652583 | 5/1995 | European Pat. Off. | H01J 29/56 |
| 62-58549 | 3/1987 | Japan . | |
| 8-148095 | 6/1996 | Japan . | |

OTHER PUBLICATIONS

2320 Proceedings of the Society for Information Display (SID); 29 (1988) No. 1, New York, NY, USA; An In–Line Color CRT With Dynamic Beam Shaping for Data Display; pp. 41–45.

*Primary Examiner*—Jay M. Patidar
*Attorney, Agent, or Firm*—Antonelli, Terry, Stout & Kraus, LLP

[57] ABSTRACT

A color display system includes a color cathode ray tube having an electron gun having at least a cathode, a control electrode, an accelerating electrode, a focus electrode and an anode. The focus electrode includes a first focus electrode, a second focus electrode and a third focus electrode. The first focus electrode faces the accelerating electrode, a first quadrupole lens is formed in at least one of opposing ends of the first and second focus electrodes. A second quadrupole lens is formed in at least one of opposing ends of the second focus electrode on the third focus electrode side and a portion of the third focus electrode on the second focus electrode side, and the second quadrupole lens is formed of at least one pair of plate electrodes extending along the tube axis and facing each other across the electron beams, wherein a dynamic focus voltage varying with deflection of electron beams is applied to the first and third focus electrodes so that the first quadrupole lens produces horizontally diverging and vertically focusing actions on the electron beams and the second quadrupole lens produces horizontally focusing and vertically diverging actions on the electron beams, and a dynamic differential focus voltage Dv and a voltage Av applied to the accelerating electrode satisfy the following inequality, $0.2 \leqq Dv/Av \leqq 4$.

4 Claims, 14 Drawing Sheets

COLOR DISPLAY SYSTEM UTILIZING DOUBLE QUADRUPOLE LENSES UNDER OPTIMAL CONTROL

SPECIFIC REFERENCE TO THE EARLIER FILED APPLICATION

This application is a continuation-in-part of my U.S. Pat. application Ser. No. 560,010 filed on Nov. 17, 1995, now abandoned, which corresponds to the Japanese Patent Application 06-291325. The disclosures of the U.S. Pat. application are hereby incorporated by reference.

BACKGROUND OF THE INVENTION

The present invention relates to a color display system and particularly to a color cathode ray system including a cathode ray tube having improved resolution over the entire phosphor screen and a color display system provided with this cathode ray tube. The resolution of a color cathode ray tube depends on the size and shape of beam spots on the phosphor screen. If the beam spot formed by impingement of an electron beam emitted from an electron gun onto the phosphor screen and resultant luminescence of the phosphor screen is small in diameter and close to a true circle, it provides a good resolution.

The electron beam emitted from the electron gun is deflected horizontally and vertically on the way to the phosphor screen and reaches the phosphor screen. The central area and peripheral area of the phosphor screen are different in the distance from the center of deflecting from each other, so that as the deflection of the electron beam increases, the shape of the beam spot elongates vertically for the most part.

In a so-called in-line electron gun emitting three electron beams, the two side electron beams are displaced from the tube axis, so that their convergence is degraded in the peripheral area of the phosphor screen and the resolution deteriorates.

FIG. 1 is a schematic cross sectional view illustrating a structure example of a color cathode ray tube to which the present invention is applied. Numeral 1 indicates a panel portion, 2 a funnel portion, 3 a neck portion, 4 a phosphor screen, and 5 a shadow mask which is a color selection electrode. Numeral 6 indicates a third electrode, 7 a fourth electrode, 8 a shield cup, 14 a deflection yoke, 15, 16, and 17 center axes of electron beams, and 18 and 19 center lines of the side electron beam passage apertures of the fourth electrode 7.

Cathode portions K1, K2, and K3, a first electrode 10, and a second electrode 20 constitute a so-called triode portion.

As shown in FIG. 1, the color cathode ray tube comprises an evacuated envelope formed of the panel portion 1 and the neck portion 3 joined to the side wall of the panel portion 1 via the funnel 2, an electron gun incorporated in the neck portion 3, the deflection yoke 14 mounted on the outer wall of the funnel portion 2 and the neck portion 3 in the neighborhood of their junction, and the multi-apertured shadow mask 5 in predetermined spaced relation adjacent to the phosphor screen 4.

Striped or dotted phosphors of red, green, and blue are coated on the phosphor screen.

Three electron beams emitted from the electron gun are color-selected by the shadow mask 5, impinge on the phosphors associated with the respective electron beams and cause the phosphors to luminesce.

The electron gun comprises an electron beam generation portion for generating, accelerating, and controlling three parallel electron beams of in-line arrangement from the cathode portions K1, K2, and K3, a prefocus lens portion for focusing the electron beams slightly, and a main lens portion for focusing the electron beams on the phosphor screen 4 and the three electron beams are deflected by the magnetic deflection yoke 14 so as to scan the beams in a rectangular raster over the phosphor screen 4.

The constitution shown in FIG. 1 is an example and a variety of electron guns are known in terms of the number of electrodes constituting the electron gun, the shapes of electron beam apertures in the electrodes, and the structures of the electrodes.

FIG. 2 is an illustration of the magnetic deflection field by the deflection yoke acting on electron beams. The magnetic deflection field by the magnetic deflection yoke has, as shown in FIG. 2, a pin cushion shaped distortion 14H in the horizontal deflection field and a barrel shaped distortion 14V in the vertical deflection field.

FIGS. 3A and 3B are illustrations of the deflection and shape distortion of an electron beam spot by the magnetic deflection field. An electron beam B deflected to the periphery of the phosphor screen is subject to diffusing force fh in the horizontal direction and focusing force fv in the vertical direction as shown in FIG. 3B in addition to the force Fh for deflecting the electron beam as shown in FIG. 3A and forms a distorted spot shape.

FIG. 4 is an illustration of the beam spot shapes on the phosphor screen. Although the beam spot 00 in the center area of the phosphor screen 3 is circular, the beam spots generated in the peripheral area of the phosphor screen are distorted to a non-circle comprising a core BC of high intensity and a halo BH and particularly the large vertical elongation of the halo BH adversely affects the focus characteristic.

As a countermeasure for degradation of the focus characteristic, for example, an art disclosed in Japanese Patent Application Laid-Open 62-58549 may be cited.

FIG. 5 is a cross sectional view illustrating the constitution of the electron gun disclosed in the aforementioned prior art. Symbols K1, K2, and K3 indicate cathodes, numeral 10 a control grid, 20 an accelerating electrode, 30 a first focus electrode, 40 a second focus electrode, 48 a rim electrode, 50 a third focus electrode, 60 an anode, 11, 12, 13, 21, 22, 23, 31, 32, 33, 41*a*, 42*a*, 43*a*, 41*b*, 42*b*, 43*b*, 51*a*, 52*a*, 53*a*, 51*b*, 52*b*, 53*b*, 61, 62, and 63 respective electron beam passage apertures thereof, 44, 45, 46, and 47 vertical plates, and 54 and 55 horizontal plates. Symbol C indicates an electron gun axis (coincides with the tube axis), S1 a displacement of each of the side electron beams from the electron gun axis C, and S2 a displacement of each of the side electron beam passage apertures 61 and 63 of the anode 60 from the electron gun axis C.

FIG. 6 is a plan view of the accelerating electrode 20 in a direction of the arrow 100 shown in FIG. 5, and FIG. 7 is also a plan view of the second focus electrode 40 in a direction of the arrow 101, and FIG. 8 is also a plan view of the third focus electrode 50 in a direction of the arrow 102.

As shown in FIG. 6, slits 24, 25, and 26 elongated in the in-line direction of the three electron beams are superposed on the three circular electron beam passage apertures 21, 22 and 23 on the first focus electrode 30 side of the accelerating electrode 20.

As shown in FIG. 7, the second focus electrode 40 has the circular electron beam passage apertures 41*b*, 42*b*, and 43*b* on the side of the third focus electrode 50, opposes the third focus electrode 50, and furthermore has a first plate electrode (vertical plate) comprising the four vertical parallel plates 44, 45, 46, and 47 which are attached on the opposite sides of each aperture so as to extend toward the third focus electrode 50.

The second focus electrode 40 has the rim electrode 48 which surrounds the first plate electrode and extends a predetermined distance from ends 44*a*, 45*a*, 46*a*, and 47*a* of the parallel plates toward the third focus electrode 50.

As shown in FIG. 8, the third focus electrode 50 has the three circular electron beam passage apertures 51*a*, 52*a*, and 53*a* on the side of the second focus electrode 40 and has a second plate electrode (horizontal plate) comprising a pair of horizontal parallel plates 54 and 55 which are attached so as to sandwich the three circular electron beam passage apertures vertically and to extend toward the second focus electrode 40. The ends 54*a* and 55*a* of the horizontal parallel plates constituting the second plate electrode extend into the rim electrode 48 of the second focus electrode 40 and are spaced a predetermined interval L from the ends 44*a*, 45*a*, 46*a*, and 47*a* of the vertical parallel plates of the second focus electrode 40 along the electron gun axis.

The anode 60 has the three circular electron beam passage apertures 61, 62, and 63 on its end face. Between the displacement S2 of the side electron beam passage apertures 61 and 63 from the electron gun axis and the displacement S1 of the cathodes K1 and K3 and the side electron beam passage apertures of the control grid 10, the accelerating electrode 20, the first focus electrode 30, the second focus electrode 40, and the third focus electrode 50 preceding the anode 60, a relation of S2>S1 is held, a main lens is formed between the third focus electrode 50 and the anode 60, and the side electron beams SB1 and SB2 are converged at a point on the phosphor screen.

In operation of the electron gun, 50 to 170 V is applied to the cathodes K1, K2, and K3, 0 to −150 V to the control grid 10, 400 to 800 v to the accelerating electrode 20, 5 to 8 kV to the second focus electrode 40 as a focus voltage Vf, 23 to 30 kV to the anode 60 as an anode voltage Eb, and a dynamic voltage Dvf which varies in synchronization with the horizontal and vertical deflections of the electron beams to the first focus electrode 30 and the third focus electrode 50.

When the electron beams are undeflected, there exists no potential difference between the first focus electrode 30, the second focus electrode 40, and the third focus electrode 50. Therefore, the presence of the parallel plates (vertical plates) 44, 45, 46, and 47 in the second focus electrode 40 and the parallel plates (horizontal plates) 54 and 55 attached to the third focus electrode 50 exerts no influence on the beams and the cross section of the electron beams are elongated horizontally by a quadrupole lens formed by the slits 24, 25, and 26 elongated in the in-line direction of the three electron beams on the side of the first focus electrode 30 of the accelerating electrode 20 but the electron beams are brought into an optimum focus on the phosphor screen by the main lens between the third focus electrode 50 and the anode 60.

FIG. 9 is an illustration of an electron beam bundle emitted from the accelerating electrode 20 under the aforementioned operating voltage condition and FIG. 10 is a schematic diagram expressing the electron beam trajectories electron-optically.

The electron beams leaving the slits 24, 25, and 26 of the accelerating electrode 20 are subjected to a strong vertical focusing action and the cross section of each electron beam is elongated horizontally on the phosphor screen as shown in FIG. 9. In this case, the H portion of high current density is formed in the center of each cross section and the L portions of low current density are formed on both sides thereof.

When the electron beam is undeflected, the electron trajectories are as shown in FIG. 10, and the electron beam is overfocused horizontally as indicated with Ph and underfocused vertically as indicated with Pv, due to spherical aberration and the focus voltage is adjusted for focus within the shown range W on the phosphor screen.

The beam spot on the phosphor screen at this time has a vertically elongated shape comprising the H portion of high current density.

FIG. 11 is an illustration of an effect on beam spots by the parallel plates (vertical plates) 44, 45, 46, and 47 in the second focus electrode 40 and the parallel plates (horizontal plates) 54 and 55 attached to the third focus electrode 50 and FIG. 12 is an illustration of an effect on a beam spot by the parallel plates (horizontal plates) 54 and 55 attached to the third focus electrode 50.

When the deflection amount of each electron beam is increased, the potentials of the first focus electrode 30 and the third focus electrode 50 is made higher than the potential of the second focus electrode 40. Therefore, a strong horizontally focusing lens action (Fv<Fh) by the parallel plates (vertical plates) (44), 45, 46, and (47) in the second focus electrode 40 as shown in FIG. 11 and a strong vertically divergent lens action Fvv by the parallel plates (horizontal plates) 54 and 55 attached to the third focus electrode 50 as shown in FIG. 12, constitute a quadrupole lens electric field and the cross section of the electron beam is shaped to be elongated vertically, and at the same time the potential difference between the third focus electrode 50 and the anode 60 is reduced, and the focusing action by the main lens is weakened, and the electron beams are brought into an optimum focus in the peripheral area of the phosphor screen.

The aforementioned quadrupole lens action acts so as to cancel the effect on the electron beams by the magnetic deflection aberration, so that the electron beams are brought into an optimum focus on the screen However, the entrance angle of the electron beam into the main lens formed by the third focus electrode 50 and the anode 60 and the beam diameter are different between the horizontal direction and the vertical direction, and it is impossible to make the shape of the beam spot closer to a circle because the lens magnification in the main lens is different between the horizontal direction and the vertical direction.

FIGS. 13A and 13B are illustrations of a light-optical equivalent of the quadrupole lens action by the second and third focus electrodes and the electron beam trajectories when the electron beams are deflected horizontally, and FIG. 13A is a horizontal cross sectional view, and FIG. 13B is a vertical cross sectional view. Numeral 70 indicates a crossover point of an electron beam equivalent to an object of the lens system, 72 a convex lens representing the horizontal focusing action by a quadrupole lens electric field formed between the second focus electrode and the third focus electrode, 73 a main lens, 74 a concave lens representing the horizontal diverging action by the magnetic deflection field, 75 a phosphor screen, 76 an electron beam trajectory, 78 a concave lens representing the vertical diverging action, 79 a convex lens representing the vertical focusing action by the magnetic deflection field, and 80 a beam impinging point on the phosphor screen.

As shown in FIGS. 13A and 13B, the electron lens system can be represented by a light-optics equivalent of a sequential arrangement of the convex, convex, and concave lenses in a horizontal cross section from the object 70 side and a sequential arrangement of the concave, convex, and convex lenses in a vertical cross section. When the lens system is adjusted for horizontally and vertically optimum focuses, the horizontal and vertical entrance angles of the beam impinging on the phosphor screen 75 have a relation of $\alpha H<\alpha V$.

Assuming that an electron beam leaves the object 70 at an exit angle $\alpha$ and impinges on a position 80 at the entrance angle $\alpha$ O on the phosphor screen via the lens system, and the potentials at the object 70 and the phosphor screen are V and V' respectively, the electron lens system magnification M can be generally expressed by $M=(\alpha/\alpha 0)\ [V/V']^{1/2}$, and the horizontal magnification MH of the lens system can be expressed by $MH=(\alpha/\alpha H)\ [V/V']^{1/2}$ and the vertical magnification MV can be expressed by $MV=\alpha/\alpha V)\ [V/V']^{1/2}$.

As mentioned above, the horizontal and vertical entrance angles of impinging on the phosphor screen 75 have a relationship of $\alpha H<\alpha V$, resulting in the relationship of the lens magnifications MV<MH, and the beam spot diameter becomes elongated horizontally.

To correct the horizontal and vertical lens magnifications, the slits 24, 25, and 26 are formed in the accelerating electrode 20 as shown in FIG. 6.

FIGS. 14A and 14B are illustrations of light-optics equivalents representing a correction of the horizontal and vertical lens magnifications by the slits of the accelerating electrode, and FIG. 14A is a horizontal cross sectional view, and FIG. 14B is a vertical cross sectional view.

As shown in FIGS. 14A and 14B, the quadrupole lens electric field generated by the slits of the accelerating electrode produces a convex lens 71 having a weak focusing action in the horizontal direction and a convex lens 77 having a strong focusing action in the vertical direction.

An electron beam emitted from the object 70 at an angle of $\alpha$ enters the convex lens 71 in the horizontal direction the focusing action of which is weaker than that in the vertical direction, so that the exit angle in the horizontal direction becomes $\alpha'$ close to $\alpha$ and the exit angle in the vertical direction becomes $\alpha''$ smaller than $\alpha$. In this case, the object position viewed from the electron beam having passed the convex lens 71 or 77 generally moves backward from the object 70. However, since the accelerating electrode is at the crossover position, this shift is small and can be ignored.

The exit angle of the electron beam in the vertical direction is made smaller than that in the horizontal direction by the quadrupole lens electric fields (convex lenses) 71 and 77 generated by the slits of the accelerating electrode. As a result, the vertical entrance angle $\alpha'V$ of an electron beam which passes through the electron lens system and strikes the beam impinging point 80 on the phosphor screen will not become excessively larger than the horizontal entrance angle $\alpha'H$, and $\alpha'V$ can be considered to be nearly equal to $\alpha'H$. Namely, the vertical and horizontal lens magnifications MV and MH can be considered nearly equal to each other.

By doing this, an optimum focus characteristic can be obtained over the entire phosphor screen.

SUMMARY OF THE INVENTION

According to the aforementioned prior art, when electron beams are undeflected, the quadrupole lens by the slits of the accelerating electrode operates so that the electron beams are elongated horizontally. Therefore, the beam spots on the phosphor screen are elongated vertically from the relation with the aforementioned current density distribution and the cross section of the electron beam is increased by correction of the difference between the horizontal and vertical focal lengths, accordingly the horizontal resolution is easily degraded.

In the prior art electron gun, for a large beam current operation the quadrupole lens formed by the slits of the accelerating electrode produces a stronger effect on the electron beam. When the beam is undeflected, the vertical diameter of the beam spot increases further, and when the electron beam is deflected to the corners of the phosphor screen, the quadrupole lens action (horizontal elongation of the cross section) on the beam is stronger and the horizontal diameter of the electron beam inside the main lens increases and consequently the spherical aberration affects more adversely, and increases the horizontal diameter of the electron beam.

These degrade uniformity of the beam spot over the entire phosphor screen depending upon the amount of the beam current.

The current density of an electron beam is unevenly distributed so that it is high in the center and low at the peripheries, and the current density distribution is easily imbalanced due to the physical variations of the electrodes and the assembly errors thereof of the electron gun. When the electron beam is deflected to the corners of the phosphor screen, the portion of low current density is imbalanced further due to the magnetic deflection field and the image quality is degraded.

An object of the present invention is to solve the aforementioned problems with the prior art and to provide a color cathode ray tube having an electron gun which can produce a satisfactory resolution over the entire phosphor screen and a color display system using it.

According to an embodiment of this invention there is provided a color display system including a color cathode ray tube having a phosphor screen and an electron gun comprising at least a cathode, a control electrode, an accelerating electrode, a focus electrode and an anode spaced axially in the order named, the focus electrode comprising a first focus electrode, a second focus electrode and a third focus electrode spaced in the order named, the first focus electrode facing the accelerating electrode, a first quadrupole lens structure being formed on at least one of a portion of the first focus electrode facing the second focus electrode and a portion of the second focus electrode facing the first focus electrode, and a second quadrupole lens structure being formed on at least one of a portion of the second focus electrode facing the third focus electrode and a portion of the third focus electrode facing the second focus electrode, and the second quadrupole lens being formed of at least one pair of plate electrodes extending along a tube axis and facing each other across the electron beams, wherein a dynamic focus voltage varying with deflection of electron beams to a voltage higher than a voltage applied to the second focus electrode is applied to the first and third focus electrodes so that the first quadrupole lens structure produces horizontally diverging and vertically focusing actions on the electron beams and the second quadrupole lens structure produces horizontally focusing and vertically diverging actions on the electron beams, and a dynamic differential focus voltage Dv and a voltage Av applied to the accelerating electrode measured with respect to the control electrode are selected to satisfy the following inequality, $0.2 \leqq Dv/Av \leqq 4$, the dynamic differential focus voltage Dv being a voltage difference between the dynamic focus voltage when the electron beams are at the center of the phosphor screen and the dynamic focus voltage when the electron beams are deflected to a corner of a useful scanned area of the phosphor screen.

According to another embodiment of this invention there is provided a color display system including a color cathode ray tube having a phosphor screen and an electron gun comprising at least a cathode, a control electrode, an accelerating electrode, a focus electrode and an anode spaced axially in the order named, the focus electrode comprising a first focus electrode, a second focus electrode, an auxiliary electrode, a third focus electrode and a fourth electrode spaced in the order named, the first focus electrode facing the accelerating electrode, a first quadrupole lens structure being formed on at least one of a portion of the first focus electrode facing the second focus electrode and a portion of the second focus electrode facing the first focus electrode, and a second quadrupole lens structure being formed on at least one of a portion of the third focus electrode facing the fourth focus electrode and a portion of the fourth focus electrode facing the third focus electrode, and the second quadrupole lens being formed of at least one pair of plate electrodes extending along a tube axis and facing each other across the electron beams, wherein a dynamic focus voltage varying with deflection of electron beams to a voltage higher than a voltage applied to the second focus electrode is applied to the first and third focus electrodes so that the first quadrupole lens structure produces horizontally diverging and vertically focusing actions on the electron beams and the second quadrupole lens structure produces horizontally focusing and vertically diverging actions on the electron beams, and a dynamic differential focus voltage Dv and a voltage Av applied to the accelerating electrode measured with respect to the control electrode are selected to satisfy the following inequality, $0.2 \leqq Dv/Av \leqq 4$, the dynamic differential focus voltage Dv being a voltage difference between the dynamic focus voltage when the electron beams are at the center of the phosphor screen and the dynamic focus voltage when the electron beams are deflected to a corner of a useful scanned area of the phosphor screen.

According to the present invention having the aforementioned constitution, when the electron beam is undeflected the horizontal and vertical lens magnifications can be made equal to each other in the main lens formed between the third focus electrode and the anode, and an electron beam emitted from the cathode produces almost a truly circular and small beam spot.

When the deflection amount of an electron beam is increased, the electron beam is initially elongated horizontally by horizontally diverging and vertically focusing actions produced by the quadrupole lens formed between the first focus electrode and the second focus electrode and subsequently by vertically diverging and horizontally focusing actions produced by the quadrupole lens formed between the second focus electrode and the third focus electrode, the imbalance between the vertical and horizontal lens magnification is corrected. Furthermore, the amount of correction is varied with the deflection amount of the electron beam, and correction in the lens magnifications can be designed as desired, and the current density distribution in the horizontally elongated electron beam bundle becomes almost uniform unlike that when the accelerating electrode 20 shown in FIG. 6 is used, and the imbalance amount in halo due to the assembling errors of the electron gun is reduced.

When an electron beam is undeflected, the electron beam emitted from the cathode can provide a truly circular and small beam spot by the main lens formed between the third focus electrode and the anode.

Furthermore, according to the present invention, when an electron beam is deflected and the voltage applied to the first focus electrode is raised, the electric field strength in the spacing between the accelerating electrode and the first focus electrode increases (the lens magnification increases) and the angle of divergence of the electron beam leaving the accelerating electrode is reduced.

This reduction of the divergence angle of the electron beam decreases the beam diameter within the preceding one of the two quadrupole lenses and the beam diameter within the main lens when the electron beam is deflected, suppresses the horizontal spreading of the electron beam at a large current and reduces the influences of spherical aberration of the main lens and those of deflection aberration produced by the magnetic deflection field. The reductions in these two aberrations improve uniformity of the shapes of the beam spots over the entire phosphor screen in a range of small to large currents.

DETAILED DESCRIPTION OF THE PREFERRED EMBODIMENTS

The embodiments of the present invention will be explained in detail hereunder with reference to the accompanying drawings.

Figure 1:
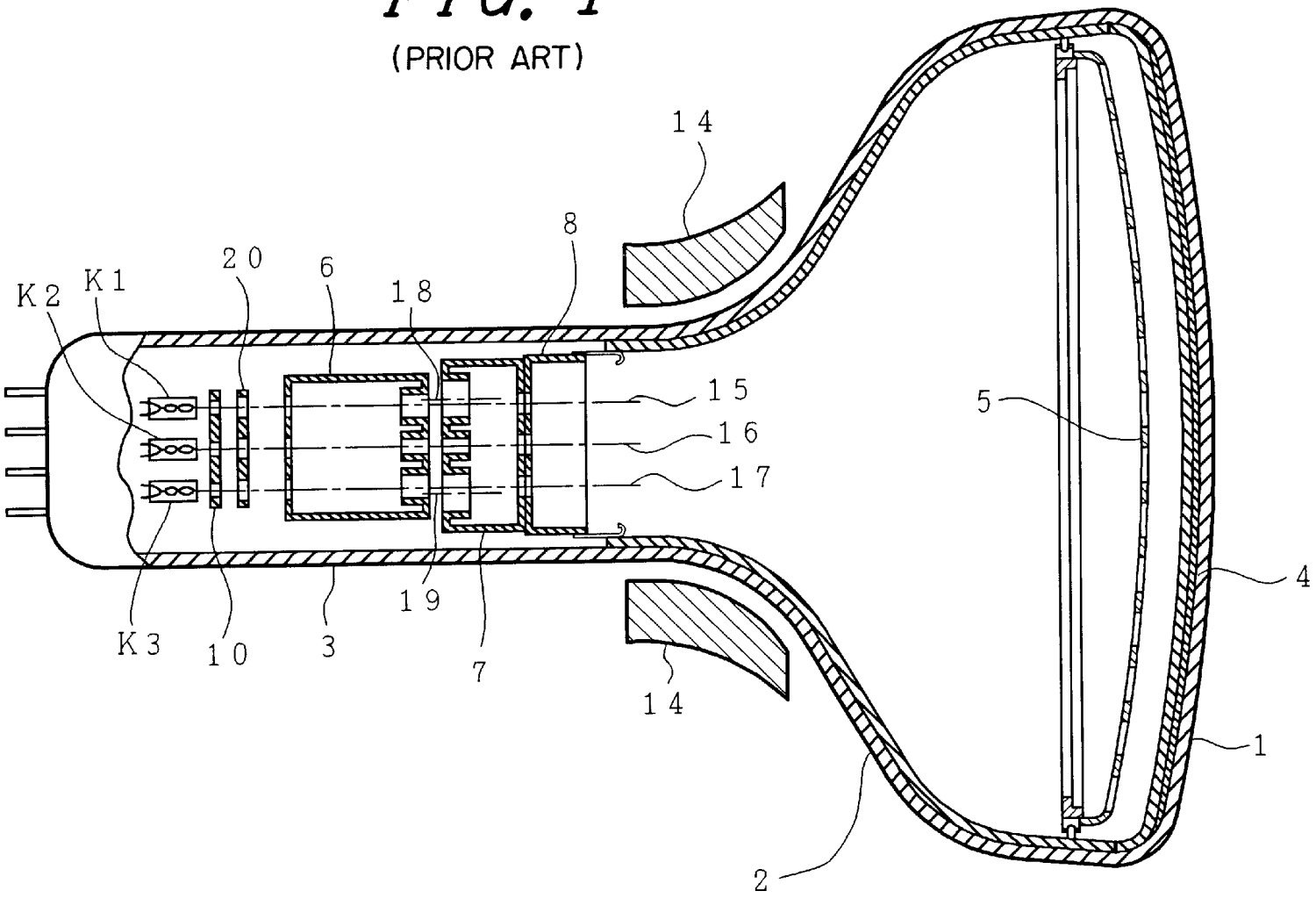
FIG. 1 (PRIOR ART)
FIG. 1 is a schematic cross sectional view illustrating a structural example of a color cathode ray tube to which the present invention is applied.
Figure 2:
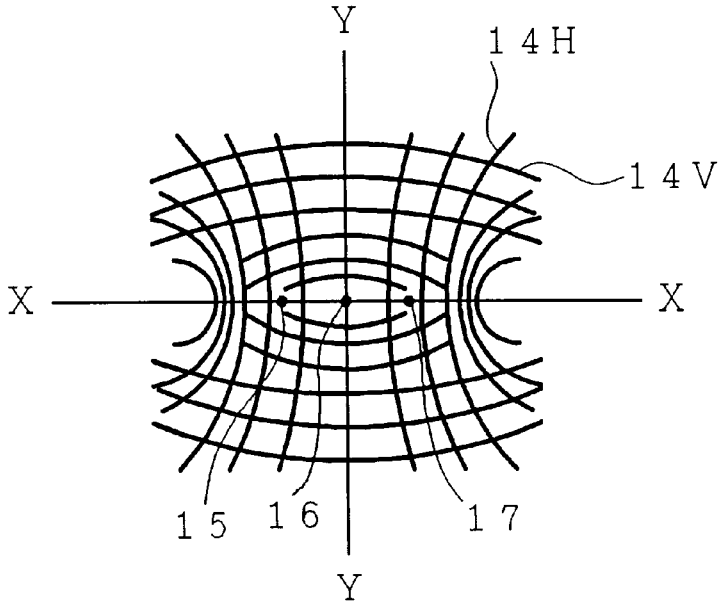
FIG. 2 (PRIOR ART)
FIG. 2 is an illustration of magnetic deflection fields acting on an electron beam generated by a deflection yoke.
Figure 3A:
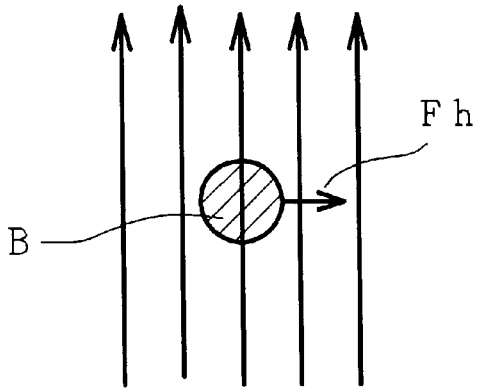
FIG. 3A (PRIOR ART)
FIGS. 3A and 3B are illustrations of deflection of an electron beam and a distortion of the shape of the electron beam spot by a magnetic deflection field.
Figure 3B:
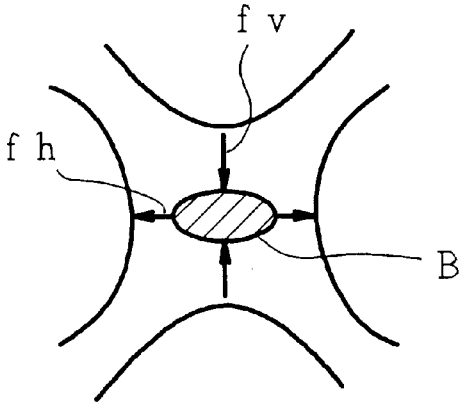
FIG. 3B (PRIOR ART)
Figure 4:
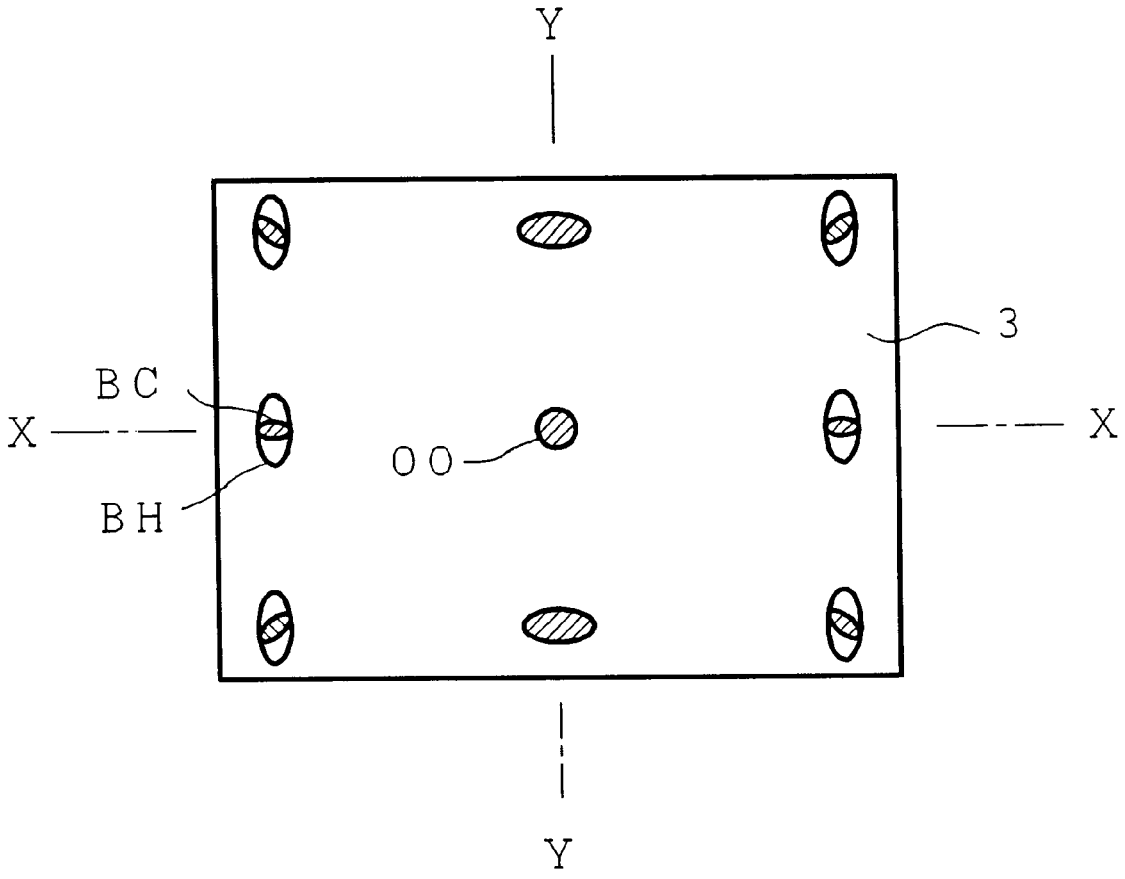
FIG. 4 (PRIOR ART)
FIG. 4 is an illustration of shapes of the beam spot on the phosphor screen.
Figure 5:
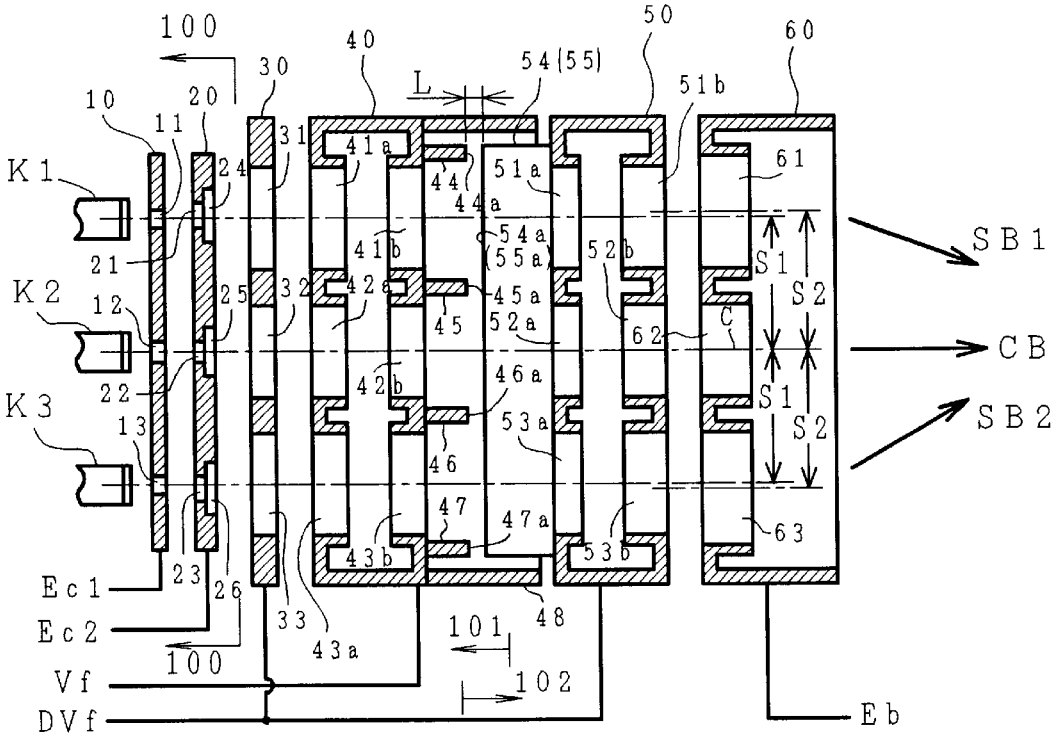
FIG. 5 (PRIOR ART)
FIG. 5 is a cross sectional view illustrating the constitution of an electron gun of the prior art.
Figure 6:
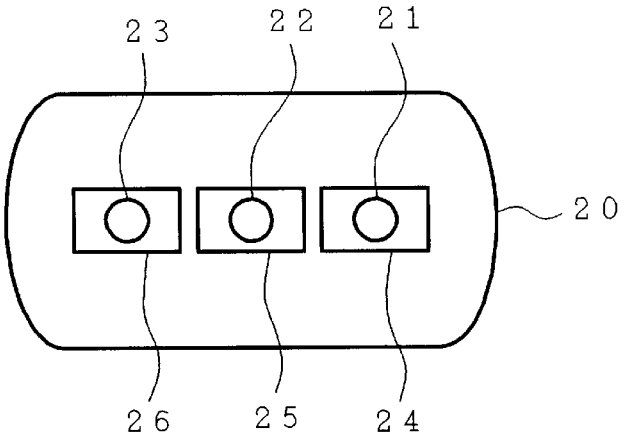
FIG. 6 (PRIOR ART)
FIG. 6 is a plan view of the accelerating electrode in a direction of the arrows 100 shown in FIG. 5.
Figure 7:
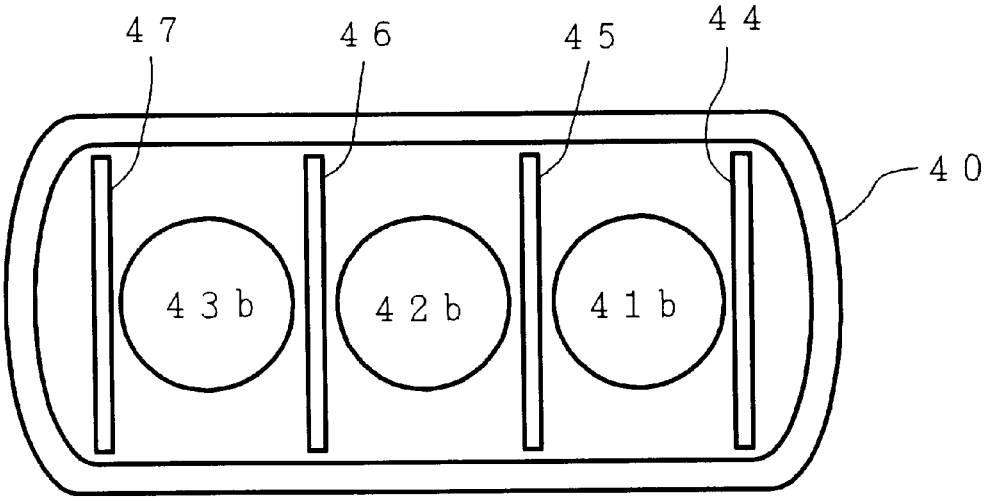
FIG. 7 (PRIOR ART)
FIG. 7 is a plan view of the second focus electrode in a direction of the arrow 101 shown in FIG. 5.
Figure 8:
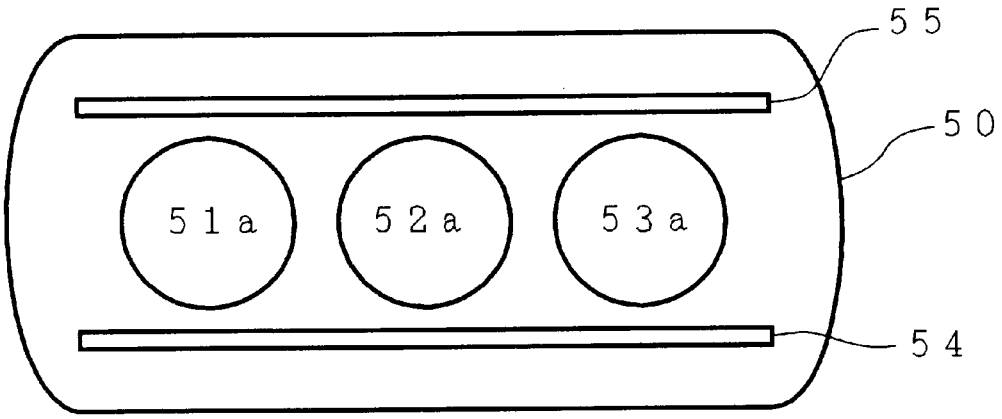
FIG. 8 (PRIOR ART)
FIG. 8 is a plan view of the third focus electrode in a direction of the arrow 102 shown in FIG. 5.
Figure 9:
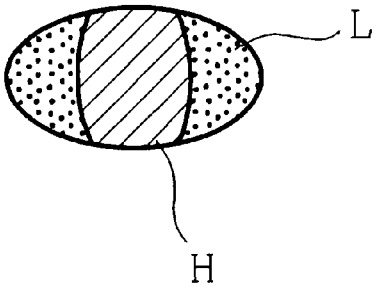
FIG. 9 (PRIOR ART)
FIG. 9 is an illustration of the beam spot shape on the phosphor screen under the operating voltage condition shown in FIG. 5.
Figure 10:
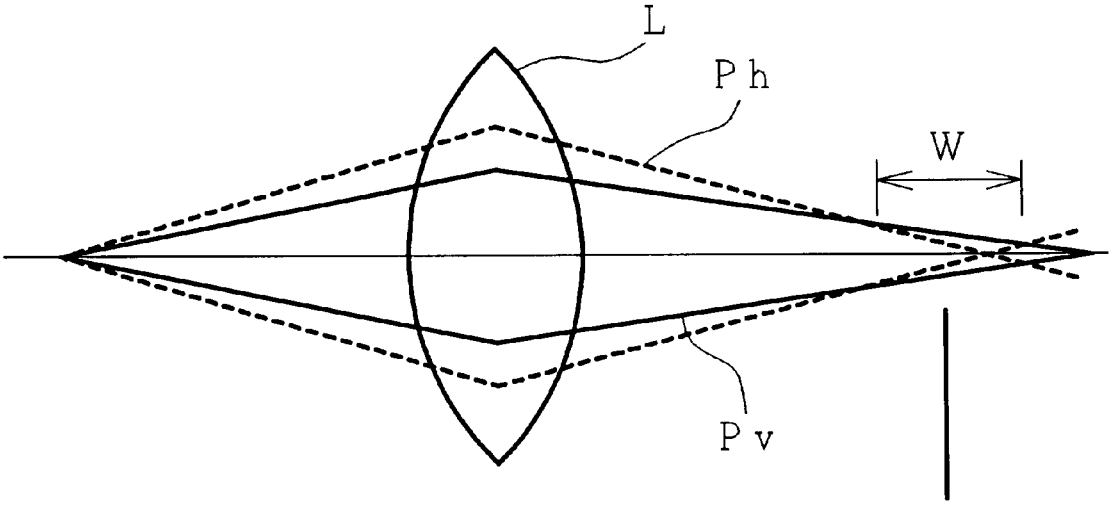
FIG. 10 (PRIOR ART)
FIG. 10 is a schematic diagram expressing a lens action on an electron beam.
Figure 11:
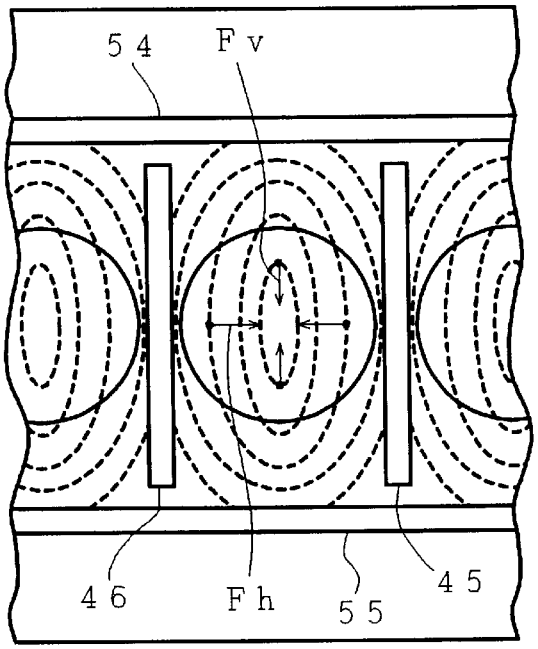
FIG. 11 (PRIOR ART)
FIG. 11 is an illustration of effects of parallel plates (vertical plates) in the second focus electrode and parallel plates (horizontal plates) attached to the third focus electrode on a beam spot.
Figure 12:
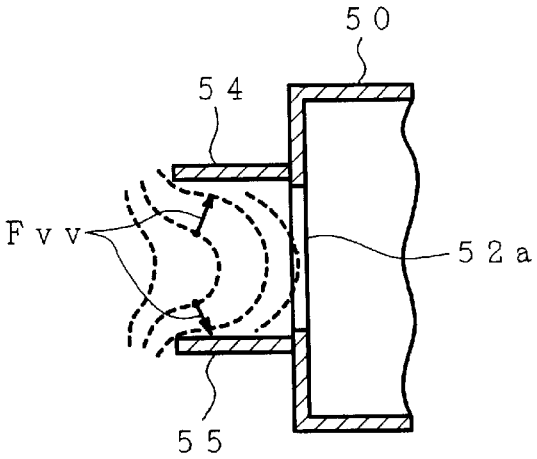
FIG. 12 (PRIOR ART)
FIG. 12 is an illustration of an effect of parallel plates (horizontal plates) attached to the third focus electrode on a beam spot.
Figure 13A:
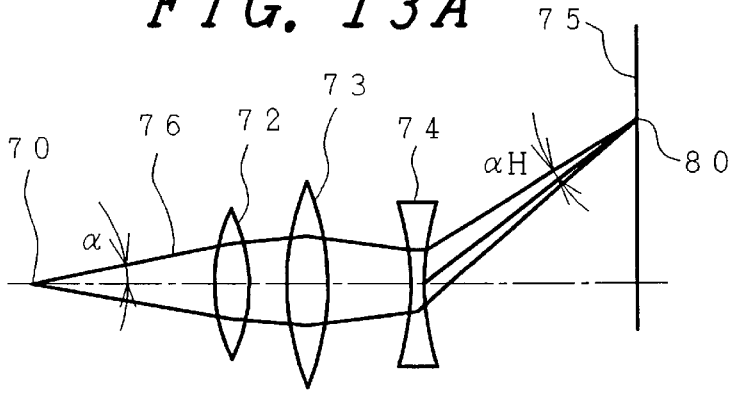
FIGS. 13A and 13B are illustrations of electron beam trajectories when an electron beam is deflected horizontally by using light-optics equivalents.
Figure 13B:
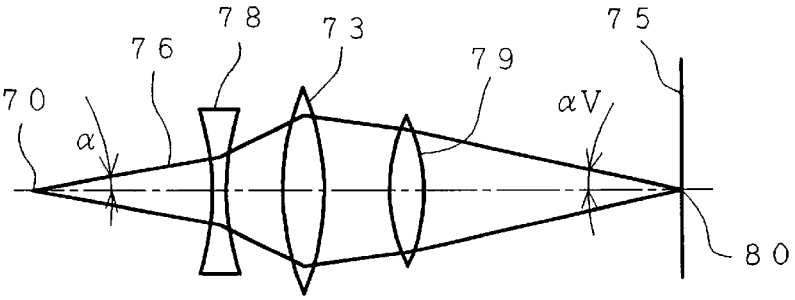
Figure 14A:
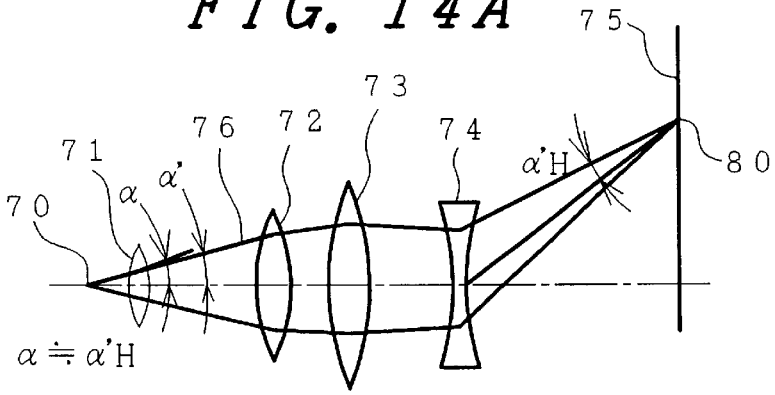
FIGS. 14A and 14B are illustrations of corrections of the horizontal and vertical lens magnifications by the slits of the accelerating electrode by using light-optics equivalents.
Figure 14B:
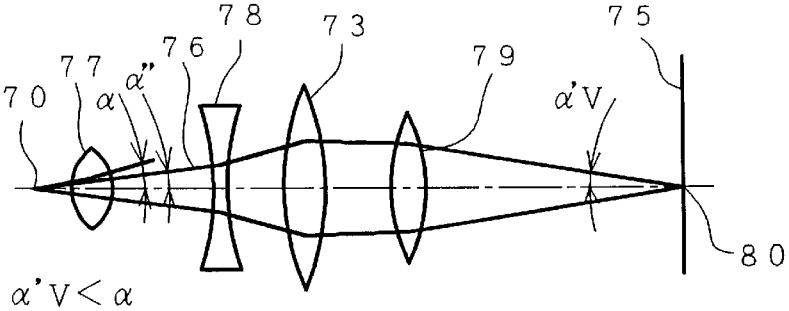
Figure 15:
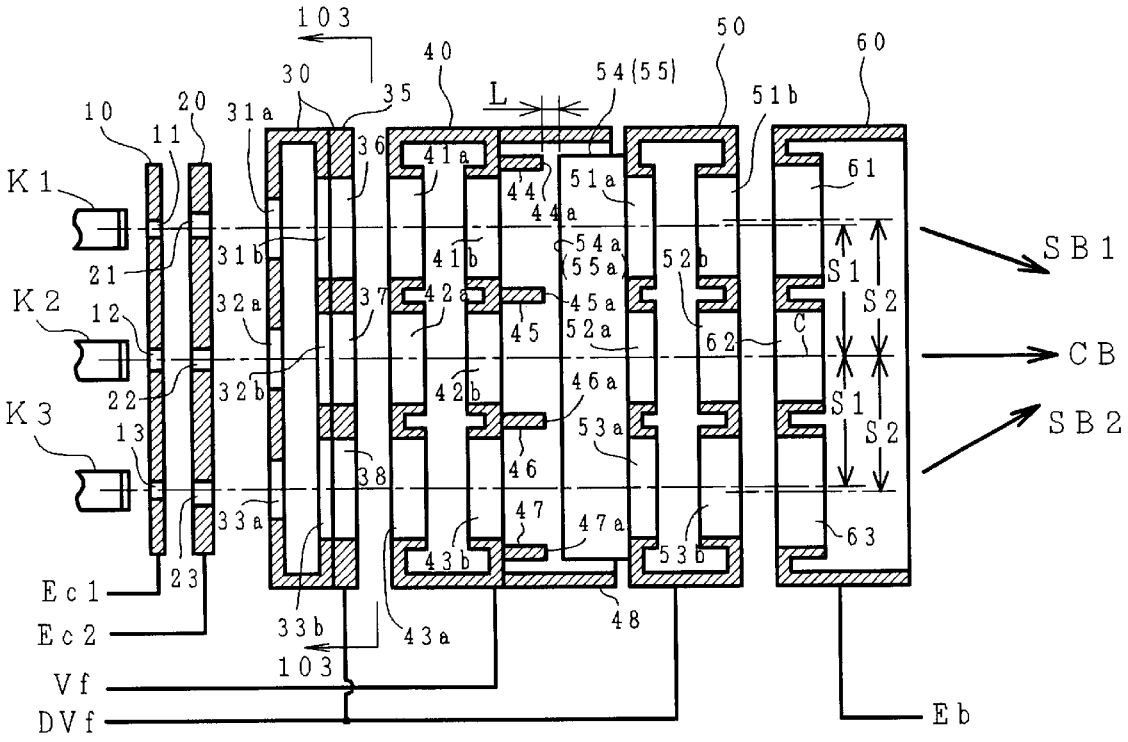
FIG. 15 is a cross sectional view illustrating the constitution of an embodiment of an electron gun for a color cathode ray tube of the present invention.

FIG. 15 is a cross sectional view illustrating the constitution of an embodiment of an electron gun for a color cathode ray tube of the present invention.

Figure 16A:
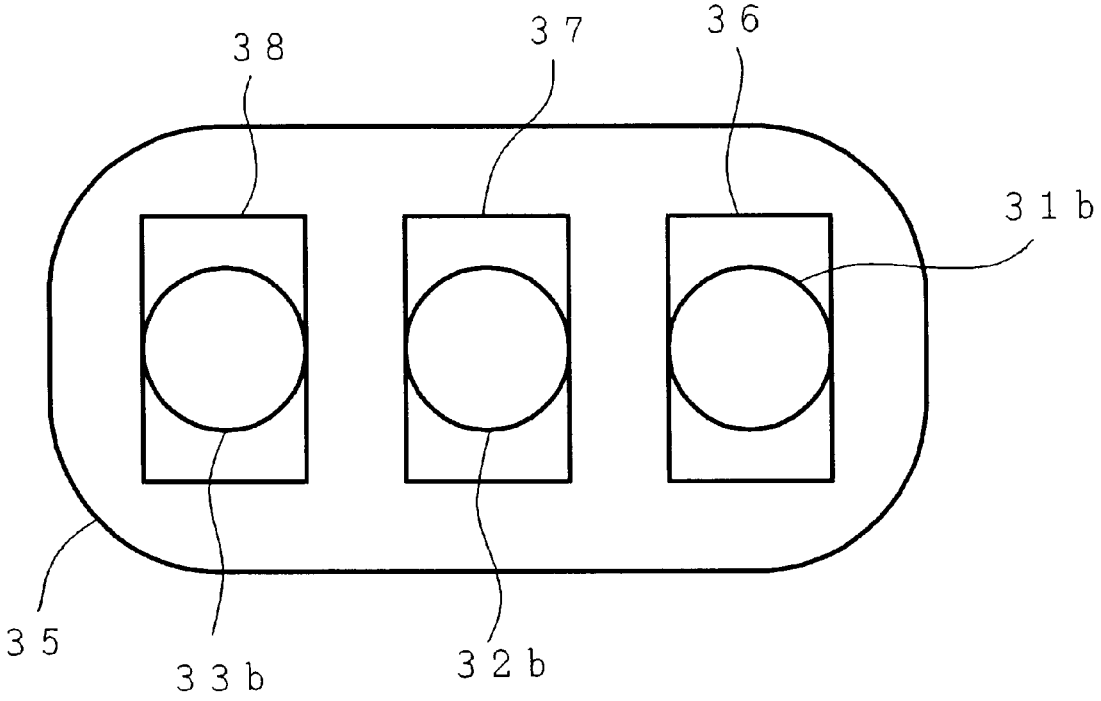
FIGS. 16A and 16B are a front view of the first focus electrode in a direction of the arrow 103 shown in FIG. 15 and an illustration of an action thereof on an electron beam respectively.
Figure 16B:
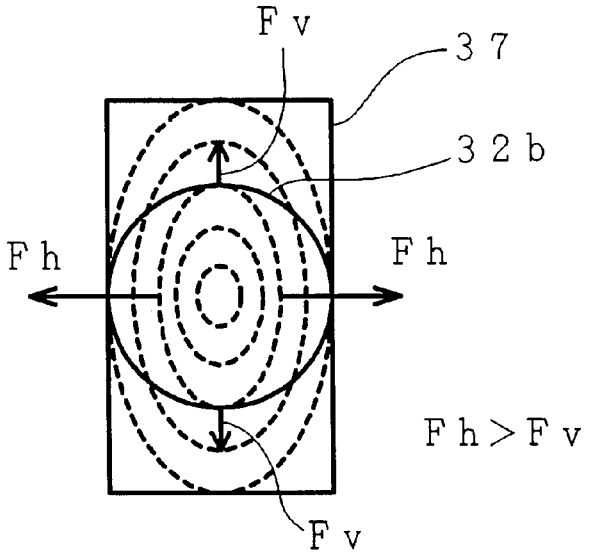

FIG. 16A is a front view of the first focus plate electrode 35 in a direction of the arrow 103 shown in FIG. 15 and FIG. 16B is an illustration of an action of the electrode shown in FIG. 16A on an electron beam.

In FIGS. 15, 16A, and 16B, symbols K1, K2, and K3 indicate cathodes, numeral 10 a control electrode, 20 an accelerating electrode, 30 a first focus electrode, 35 a first focus plate electrode, 40 a second focus electrode, 48 a rim electrode, 50 a third focus electrode, 60 an anode, 11, 12, 13, 21, 22, 23, 31*a*, 32*a*, 33*a*, 31*b*, 32*b*, 33*b*, 41*a*, 42*a*, 43*a*, 41*b*, 42*b*, 43*b*, 51*a*, 52*a*, 53*a*, 51*b*, 52*b*, 53*b*, 61, 62, and 63 electron beam passage apertures thereof, respectively, 36, 37, and 38 vertically elongated rectangular apertures, 44, 45, 46, and 47 vertical plates, and 54 and 55 horizontal plates.

Symbol C indicates an electron gun axis (coincides with the tube axis), S1 a displacement of each of the side electron beams from the electron gun axis C, and S2 a displacement of each of the side electron beam passage apertures 61 and 63 of the anode 60 from the electron gun axis C.

The first focus electrode 30 has the circular beam passage apertures 31*a*, 32*a*, 33*a*, 31*b*, 32*b*, and 33*b*. The first focus plate electrode 35 has the vertically elongated rectangular apertures 36, 37, and 38 and is electrically connected to the first focus electrode 30.

The second focus electrode 40 has a first plate electrode (vertical plate) formed of the four vertical parallel plates 44, 45, 46, and 47 attached on the opposite sides of each of the three circular electron beam passage apertures 41*b*, 42*b*, and 43*b* on its end face on the side of the third focus electrode 50. The second focus electrode 40 has the rim electrode 48 which surrounds the first plate electrode and extends a predetermined distance from ends 44*a*, 45*a*, 46*a*, and 47*a* of the parallel plates toward the third focus electrode 50.

The third focus electrode 50 has the three circular electron beam passage apertures 51*a*, 52*a*, and 53*a* in its end face on the side of the second focus electrode 40 and has a second plate electrode (horizontal plate) formed of a pair of horizontal parallel plates 54 and 55 attached thereon and extending toward the second focus electrode 40 so as to sandwich the electron beam passage apertures vertically.

The ends 54*a* and 55*a* of the parallel plates 54 and 55 constituting the second plate electrode extend into the rim electrode 48 of the second focus electrode 40 and are spaced a predetermined interval L from the ends 44*a*, 45*a*, 46*a*, and 47*a* of the vertical parallel plates of the second focus electrode 40 along the electron gun axis.

In the end face of the anode 60, the three circular electron beam passage apertures 61, 62, and 63 are formed. Between the displacement S2 of the side electron beam passage apertures in the anode 60 from the electron gun axis and the displacement S1 of the cathodes K1 and K3, and the side electron beam passage apertures of the control grid 10, of the accelerating electrode 20, of the second focus electrode 40, and of the third focus electrode 50, a relation of S2>S1 is maintained, a main lens is formed between the third focus electrode 50 and the anode 60, and the side electron beams SB1 and SB2 are designed to converge on the center electron beam CB on the phosphor screen.

In operation of the electron gun, 50 to 170 V is applied to the cathodes, 0 to −150 V to the control grid, 200 to 1000 v to the accelerating electrode 20, 4 to 10 kV to the second focus electrode 40 (hereinafter vf), 23 to 30 kV to the anode (hereinafter Eb), and a dynamic voltage Dvf which varies in synchronization with the horizontal and vertical deflections of the electron beams to the first focus electrode 30, the first focus plate electrode 35, and the third focus electrode 50.

When the electron beams are undeflected, there exists no potential difference between the first focus electrode 30, the first focus plate electrode 35, the second focus electrode 40, and the third focus electrode 50. Therefore, the presence of the vertically elongated rectangular apertures 36,37, and 38 in the first focus plate electrode 35, the parallel plates (vertical plates) 44, 45, 46, and 47 in the second focus electrode 40, and the parallel plates (horizontal plates) 54 and 55 attached to the third focus electrode 50 exerts no influence on the electron beams and the electron beams from the cathodes form circular and small beam spots on the phosphor screen by the main lens formed between the third focus electrode 50 and the anode 60.

Figure 17:
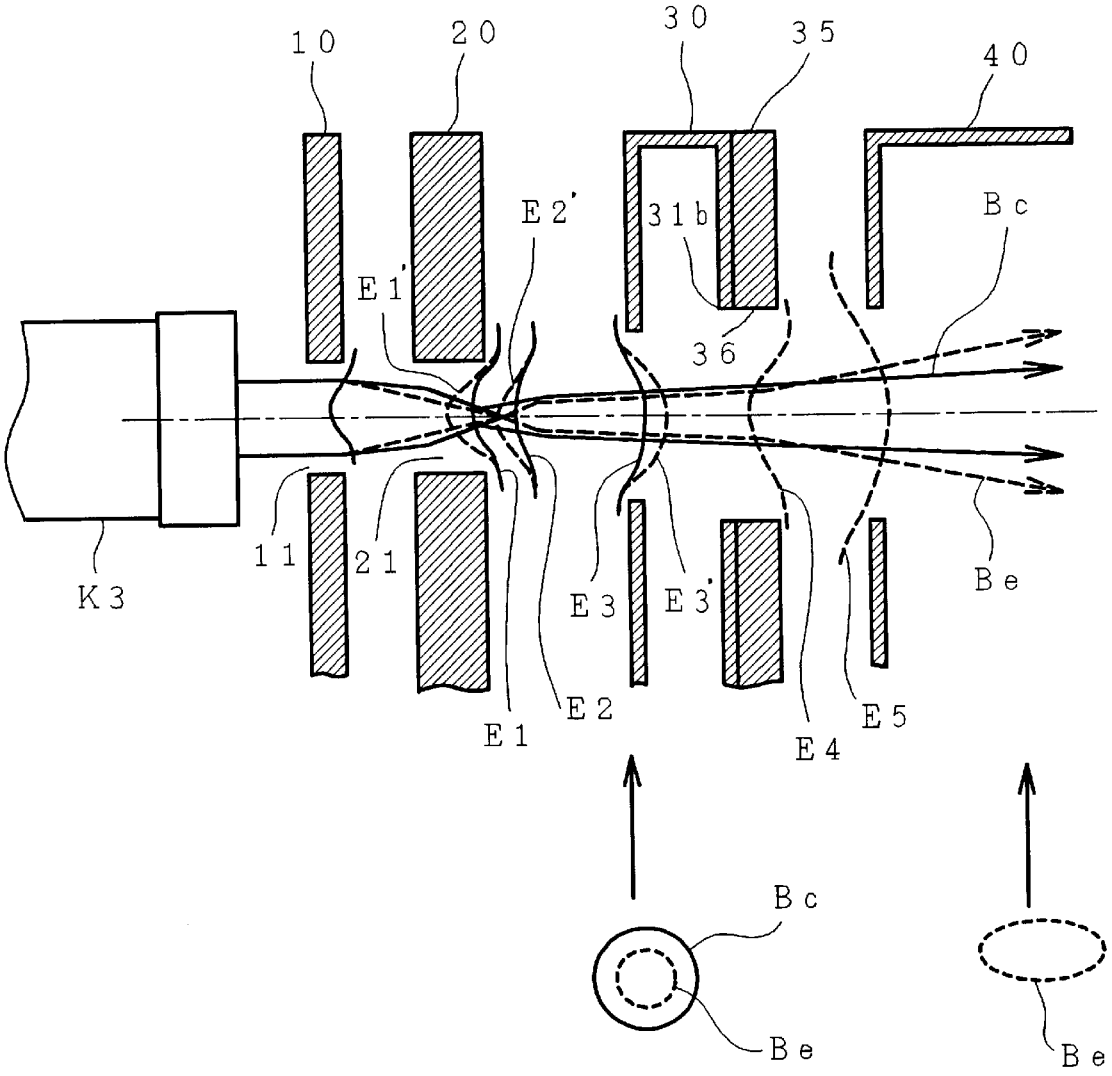
FIG. 17 illustrates a lens action on an electron beam in the neighborhood of the accelerating electrode shown in FIG. 15.

When the deflection amount of an electron beam increases and the potential of the first focus electrode 30 increases as shown in FIG. 17, the potential difference between the first focus electrode 30 and the accelerating electrode 20 increases further and the equipotential lines E1, E2, and E3 indicated by solid lines between the first focus electrode 30 and the accelerating electrode 20 change to more sharply curved equipotential lines E1', E2', and E3' indicated by dotted lines.

The electron beam at this time is subjected to a stronger focusing action than that when the magnetic deflection field is 0, and the angle of beam divergence of the electron beam trajectory Bc in the aperture 31*b* of the first focus electrode 30 is reduced as indicated by the trajectory Be, and the electron beam enters between the first focus plate electrode 35 and the second focus electrode 40, is horizontally elongated in its cross section by the quadrupole lens action, and then enters the lenses between the second focus electrode 40 and the third focus electrode 50 and between the third focus electrode 50 and the anode 60, successively.

A dynamic voltage varying by an amount (200 to 800 V for the useful scanned area of the phosphor screen, for example) close to a voltage applied to the accelerating electrode 20 (200 to 1000 V, for example) is applied to the first focus electrode 30 facing the accelerating electrode 20 supplied with a comparatively low voltage (200 to 1000 V, for example) synchronized with deflection of the beam, resulting in effective dynamic focusing.

It is preferable that a dynamic differential focus voltage Dv for the useful scanned area of the phosphor screen of the color cathode ray tube and a voltage Av applied to the accelerating electrode 20 measured with respect to the control electrode 10 satisfy the following inequality, $0.2 \leqq Dv/Av \leqq 4$ where a dynamic differential focus voltage Dv is a voltage difference between a dynamic focus voltage when the beam is at the center of the phosphor screen and a dynamic focus voltage when the beam is at the extreme right or left edge and the top or the bottom of the useful scanned area on the phosphor screen.

In the present invention, when an electron beam is deflected, the spreading of the electron beam due to an increase in the current can be suppressed by the enhanced focus lens action by the accelerating electrode 20 and particularly the effect of the spherical aberration due to the horizontal spreading in the main lens by the quadrupole lens formed between the first focus plate electrode 35 and the second focus electrode 40 can be suppressed.

Although the effect of the quadrupole lens formed between the first focus plate electrode 35 and the second focus electrode 40 is reduced because the ratio of the diameter of the electron beam to the diameter of the quadrupole lens is reduced, the beam diameter in the magnetic deflection field is also reduced, aberration caused by the magnetic deflection field (quadrupole lens) is reduced, and a correction of the imbalance between the horizontal and vertical lens magnifications can be maintained.

When the deflection amount of an electron beam increases, the potentials of the first focus electrode 30, the first focus plate electrode 35, and the third focus electrode 50 become higher than the potential of the second focus electrode 40, a vertically elongated divergent lens is formed as shown in FIG. 16B by the vertically elongated slits 36, 37, and 38 of the first focus plate electrode 35 and the electron beam is subjected to a diverging action stronger in the horizontal direction than that in the vertical direction (Fh>Fv) and horizontally elongated in its cross section.

The aforementioned quadrupole lens electric field for elongating an electron beam vertically is formed by the parallel plates (vertical plates) 44, 45, 46, and 47 in the second focus electrode 40 and the parallel plates (horizontal plates) 54 and 55 attached to the third focus electrode 50, and the potential difference between the third focus electrode 50 and the anode 60 is reduced, and the focusing action by the main lens is weakened.

Since the diameter of the quadrupole lens is large compared to the bundle of horizontally elongated electron beams shaped by the quadrupole lens between the first focus plate electrode 35 and the second focus electrode 40, the current density distribution becomes uniform. An imbalance of the lens magnifications for the horizontally elongated electron beams is corrected between the second focus electrode 40 and the third focus electrode 50 and between the third focus electrode 50 and the anode 60.

In the above embodiment, one of the two sets of the parallel plates can be omitted, one set of the vertical plates 44, 45, 46 and 47, or another set of the horizontal plates 54 and 55.

Figure 18:
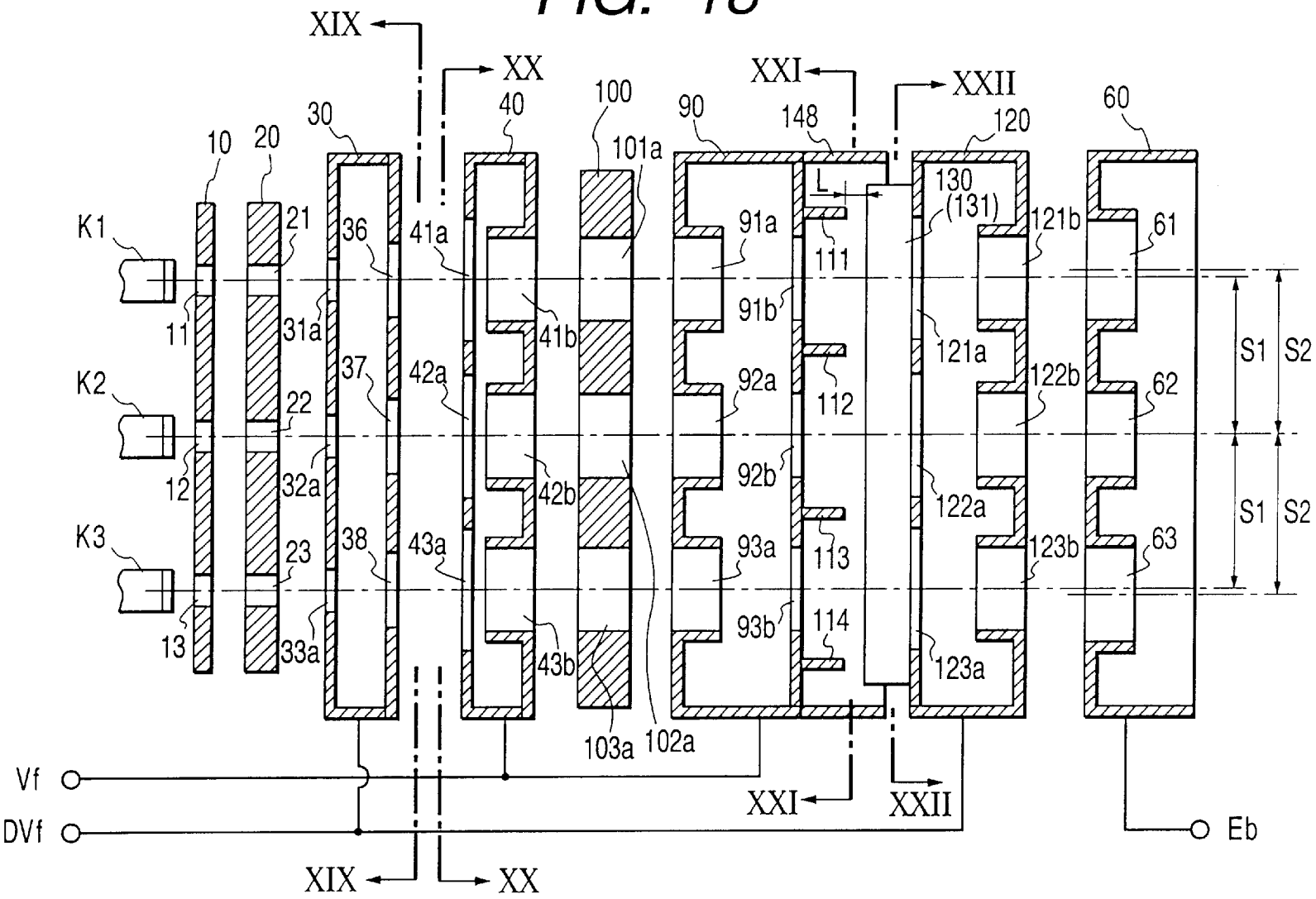
FIG. 18 is a cross sectional view illustrating the constitution of another embodiment of an electron gun for a color cathode ray tube of the present invention.

FIG. 18 is a cross sectional view illustrating the constitution of another embodiment of an electron gun for a color cathode ray tube of the present invention.

The electron gun of this embodiment is comprised of cathodes K1, K2 and K3, a control electrode 10, an accelerating electrode 20, a first focus electrode 30, a second focus electrode 40, an auxiliary electrode 100, a third focus electrode 90, a rim electrode 148, a fourth focus electrode 120 and an anode 60 arranged in the order named. Cathodes K1, K2 and K3 are arranged in a line perpendicular to the tube axis, and the control electrode 10, the accelerating electrode 20, the first focus electrode 30, the second focus electrode 40, the auxiliary electrode 120, the third focus electrode 90, the fourth focus electrode 90 and the anode 60 have three in-line electron beam apertures.

The control electrode 10 has three electron beam apertures 11, 12 and 13, the accelerating electrode 20 has three electron beam apertures 21, 22 and 23.

Figure 19A:
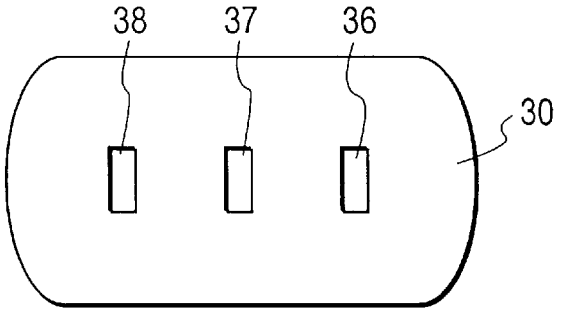
FIG. 19A is a front view of one example of a first focus electrode in a direction of the arrows XIX shown in FIG. 18
Figure 19B:
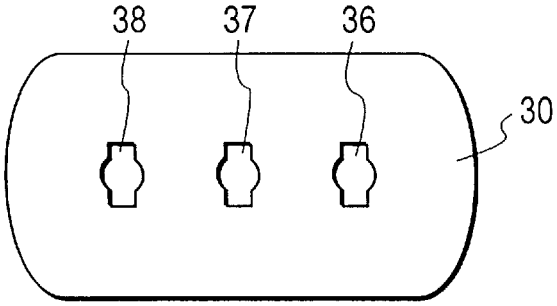
FIG. 19B is a front view of another example of a first focus electrode in a direction of the arrows XIX shown in FIG. 18.

The first focus electrode 30 is a combination of two cup-shaped electrodes or a combination of a cup-shaped electrode and a plate electrode having three circular electron beam apertures 31*a*, 32*a* and 33*a* on the side of the accelerating electrode 20, and having three vertically elongated rectangular apertures as shown in FIG. 19A or three key-hole apertures with their rectangles vertically elongated as shown in FIG. 19B, 36, 37 and 38 on the side of the second focus electrode 40.

Figure 20A:
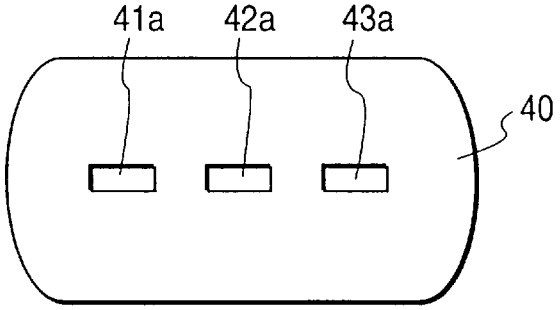
FIG. 20A is a front view of one example of a second focus electrode in a direction of the arrows XX shown in FIG. 18
Figure 20B:
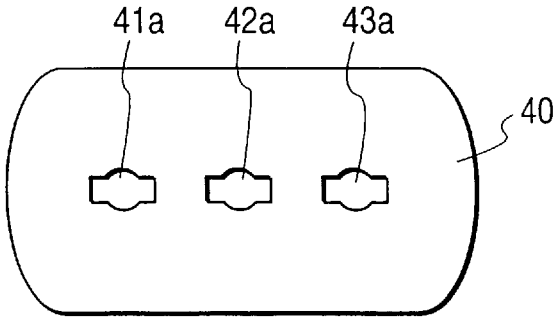
FIG. 20B is a front view of another example of a second focus electrode in a direction of the arrows XX shown in FIG. 18.

The second focus electrode 40 is a combination of two cup-shaped electrodes or a combination of a cup-shaped electrode and a plate electrode having three horizontally elongated rectangular apertures as shown in FIG. 20A, or three key-hole apertures with their rectangles horizontally elongated as shown in FIG. 20B, 41*a*, 42*a* and 43*a* on the side of the first focus electrode 30 and having three circular electron beam apertures 41*b*, 42*b* and 43*b* on the side of the auxiliary electrode 100.

The auxiliary electrode 100 is a combination of two cup-shaped electrodes, a combination of a cup-shaped electrode and a plate electrode or a thick plate electrode having three circular beam apertures 101*a*, 102*a* and 103*a*.

Figure 21:
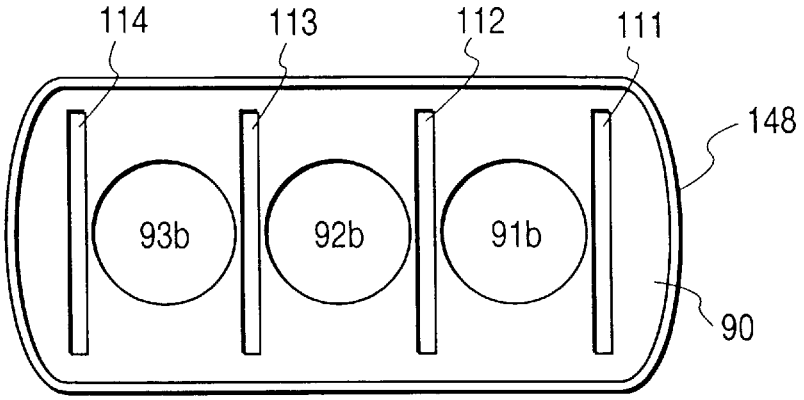
FIG. 21 is a plan view of the third focus electrode in a direction of the arrows XXI shown in FIG. 18.

The third focus electrode 90 has three circular electron beam apertures 91*a*, 92*a* and 93*a* on the side of the auxiliary electrode 100 and has three circular beam apertures 91*b*, 92*b* and 93*b* on the side of the fourth focus electrode 120. Plate electrodes 111, 112, 113 and 114 are fixed to the third focus electrode 90 on the side of the fourth electrode 120 such that they extend toward the fourth focus electrode 120 parallel with the tube axis and sandwich each of the paths of the three electron beams in the in-line direction of the three beams as shown in FIG. 21. The rim electrode 148 is fixed to the third focus electrode 90 such that it surrounds the plate electrodes 111, 112, 113 and 114.

Figure 22A:
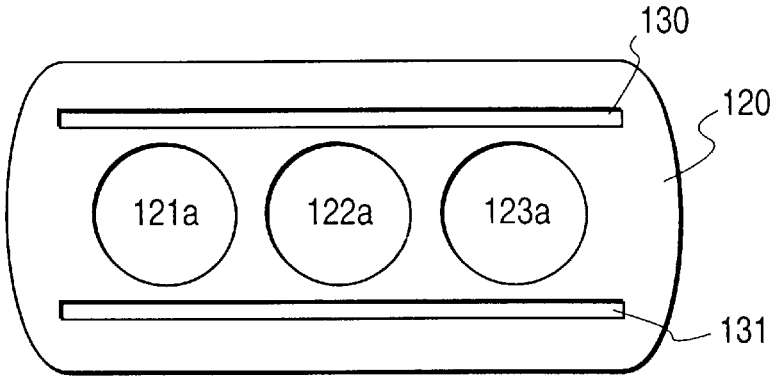
FIG. 22A is a front view of one example of a fourth focus electrode in a direction of the arrows XXII shown in FIG. 18

The fourth focus electrode 120 has three circular electron beam apertures 121*a*, 122*a* and 123*a* on the side of the third focus electrode 90 and has three circular beam apertures 121*b*, 122*b* and 123*b* on the side of the anode. A pair of plate electrodes 130 (131) are fixed to the fourth focus electrode 120 such that they extend into the rim electrode 148 parallel with the tube axis, and sandwich the paths of the three electron beams perpendicularly to the in-line direction of the three beams as shown in FIG. 22A.

The rearward ends of the plate electrodes 130 (131) is spaced a predetermined distance L from the forward ends of the plates 111, 112, 113 and 114.

Figure 22B:
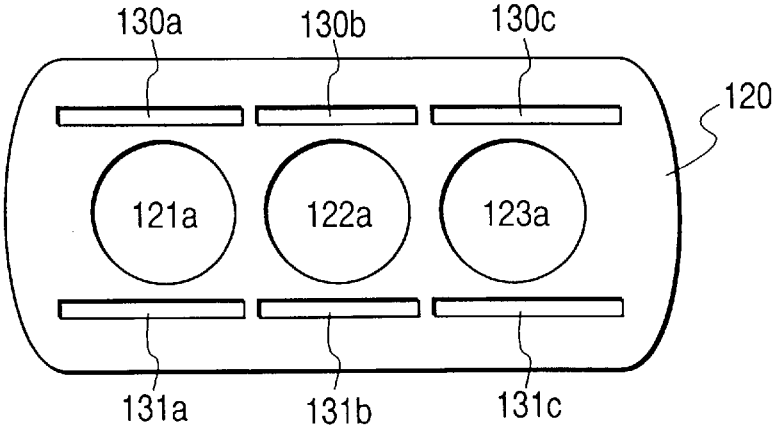
FIG. 22B is a front view of another example of a fourth focus electrode in a direction of the arrows XXII shown in FIG. 18.

The pair of plate electrodes 130 (131) can be replaced with three separate pairs of plate electrodes (130*a*, 131*a*), (130*b*, 13*b*), (130*c*, 131*c*), each pair of plate electrodes being for one electron beam, as shown in FIG. 22B.

The anode 60 has three in-line electron beam apertures 61, 62 and 63. The center of the beam apertures for the side electron beams in the anode 60 are displaced outwardly with respect to the center of the beam apertures for the side electron beams in the electrodes from the control electrode 10 to the fourth focus electrode 120.

In operation of the electron gun, 40 to 190 V is applied to the cathodes K1, K2 and K3, −80 to 50 V to the control grid 10, a low voltage of 300 to 1000 V to the accelerating electrode 20, a medium focus voltage Vf of 5 kV to 10 kV to the second focus electrode 40, the third focus electrode 90 and the rim electrode 148, a focus voltage Dvf dynamically varying from the medium voltage synchronized with the current supplied to the deflection yoke for scanning the electron beams to the first focus electrode 30 and the fourth focus electrode 120, a high voltage Eb of 22 kV to 35 kV to the anode 60. The auxiliary electrode 100 is electrically connected to the accelerating electrode 20 supplied with a voltage of 300 v to 1000 V, lower than the focus voltage Vf, or is electrically connected to the anode supplied with a high voltage Eb. The range of the dynamic differential focus voltage is within a range of 200 to 2000 v.

When the electron beams are undeflected, there exists no potential difference between the first focus electrode 30 and the second focus electrode 40, and between the third focus electrode 90 and the fourth focus electrode 120. The electron beams emitted from the cathodes K1, K2 and K3 become divergent after they are focused by the control electrode 10 and the accelerating electrode 20, then are focused to some extent by electrostatic lenses formed between the second focus electrode 40 and the auxiliary electrode 100 and between the auxiliary electrode 100 and the third focus electrode 90, enter a final lens; that is a main lens, formed between the fourth electrode 120 and the anode 60 and are brought into an optimum focus on the phosphor screen.

When the beams are deflected to the periphery of the phosphor screen, the dynamic focus voltage Dvf applied to the first focus electrode 30 and the fourth focus electrode 120 becomes higher in synchronization with the current through the deflection yoke than when the electron beams are undeflected. At this time, due to a potential difference between the first focus electrode 30 and the second focus electrode 40, each of the electron beam apertures 36, 37 and 38 in the first focus electrode 30 produces a diverging lens stronger in the in-line direction of the three electron beam, that is, horizontally, than perpendicularly to the in-line direction, that is, vertically, and each of the electron beam apertures 41*a*, 42*a* and 43*a* in the second focus electrode 40 produces a focusing lens stronger vertically than horizontally, and consequently the bundle of the electron rays forms a horizontally elongated cross section. In the region between the third focus electrode 90 and the fourth focus electrode 120, two adjacent ones of the plate electrodes 111, 112, 113 and 114 fixed to the third focus electrode 90 produce a focusing lens stronger horizontally than vertically, the plate electrodes 130 and 131 fixed to the fourth electrode 120 produce a diverging lens stronger vertically than horizontally, and consequently the lens action in this region elongates the cross section of the bundle of electron rays vertically. A combination of a first quadrupole lens formed between the first focus electrode 30 and the second focus electrode 40 which elongates the beam cross section horizontally and a second quadrupole lens formed between the third focus electrode 90 and the fourth focus electrode 120 can make focus lengths in the horizontal and vertical directions coincident with each other when the beams are deflected to the periphery of the phosphor screen. The difference in distance from the center of the beam deflection to the phosphor screen between the undeflected beam and the electron beam deflected to the periphery of the screen is compensated for by reduction of the magnification of the main lens caused by the decrease in the potential difference between the fourth focus electrode 120 and the anode 60, resulting in an optimum focus over the entire phosphor screen.

It is also preferable in this embodiment that a dynamic differential focus voltage Dv for the useful scanned area of the phosphor screen of the color cathode ray tube and a voltage Av applied to the accelerating electrode 20 measured with respect to the control electrode 10 satisfy the following inequality, $0.2 \leqq Dv/Av \leqq 4$ where a dynamic differential focus voltage Dv is a voltage difference between a dynamic focus voltage when the beam is at the center of the phosphor screen and a dynamic focus voltage when the beam is at the extreme right or left edge and the top or the bottom of the useful scanned area on the phosphor screen.

In this embodiment, since the focus voltage dynamically varying in synchronization with the beam deflection is applied to the first focus electrode 30 adjacent to the accelerating electrode 20 and an excessive dynamic differential focus voltage Dv adversely effects the magnitude of the beam cutoff voltage, the dynamic differential focus voltage Dv must be kept within the limits. The inventor of the present invention found that it is preferable that the dynamic differential focus voltage satisfy the above inequality. The dynamic differential focus voltage Dv limited in the range as specified above reduces the flexibility in the design of the strength of a quadrupole lens, but the quadrupole lens comprised of two pairs of two opposing plates are most flexible enough to make up for the reduced dynamic differential focus voltage Dv.

In the above embodiment, one of the two sets of the parallel plates can be omitted, one set of the vertical plates 111, 112, 113 and 114, or another set of the horizontal plates 130 and 131.

According to the present invention, satisfactory resolution can be obtained over the entire phosphor screen.

As mentioned above, according to the present invention, an electron beam emitted from the cathode is subject to the equal horizontal and vertical lens magnifications of the main lens between the third focus electrode and the anode when the electron beam is not deflected, so that the electron beam spot becomes almost truly circular and small.

When the deflection amount of an electron beam is increased, the electron beam is elongated horizontally by the quadrupole lens exerting horizontally diverging and vertically focusing actions formed between the first focus electrode and the second focus electrode and then an imbalance between the vertical and horizontal lens magnifications is corrected by the quadrupole lens exerting vertically diverging and horizontally focusing actions formed between the second focus electrode and the third focus electrode.

According to the present invention, satisfactory resolution can be produced over the entire phosphor screen of from high to low brightness.

What is claimed is:

1. A color display system including a color cathode ray tube having a phosphor screen and an electron gun comprising at least a cathode, a control electrode, an accelerating electrode, a focus electrode and an anode spaced axially in the order named, said focus electrode comprising a first focus electrode, a second focus electrode and a third focus electrode spaced in the order named, said first focus electrode facing said accelerating electrode, a first quadrupole lens structure being formed on at least one of a portion of said first focus electrode facing said second focus electrode and a portion of said second focus electrode facing said first focus electrode, and a second quadrupole lens structure being formed on at least one of a portion of said second focus electrode facing said third focus electrode and a portion of said third focus electrode facing said second focus electrode, and said second quadrupole lens being formed of at least one pair of plate electrodes extending along a tube axis and facing each other across the electron beams, wherein a dynamic focus voltage varying with deflection of electron beams to a voltage higher than a voltage applied to said second focus electrode is applied to said first and third focus electrodes so that said first quadrupole lens structure produces horizontally diverging and vertically focusing actions on the electron beams and said second quadrupole lens structure produces horizontally focusing and vertically diverging actions on the electron beams, and a dynamic differential focus voltage Dv and a voltage Av applied to said accelerating electrode measured with respect to said control electrode are selected to satisfy the following inequality, $0.2 \leqq Dv/Av \leqq 4$, said dynamic differential focus voltage Dv being a voltage difference between said dynamic focus voltage when the electron beams are at the center of said phosphor screen and said dynamic focus voltage when the electron beams are deflected to a corner of a useful scanned area of said phosphor screen.

2. A color display system according to claim 1, wherein a voltage applied to said control electrode is within a range of −150 to 0 V, said voltage applied to said accelerating electrode is within a range of 200 to 1000 V, a voltage applied to said second focus electrode is within a range of 4 kV to 10 kV, a voltage applied to said anode is within a range of 23 kV to 30 kV, and a voltage applied to said first and third electrodes is within a range of said dynamic differential focus voltage plus said voltage applied to said second focus electrode, said range of said dynamic differential focus voltage being within a range of 200 to 800 V.

3. A color display system including a color cathode ray tube having a phosphor screen and an electron gun comprising at least a cathode, a control electrode, an accelerating electrode, a focus electrode and an anode spaced axially in the order named, said focus electrode comprising a first focus electrode, a second focus electrode, an auxiliary electrode, a third focus electrode and a fourth electrode spaced in the order named, said first focus electrode facing said accelerating electrode, a first quadrupole lens structure being formed on at least one of a portion of said first focus electrode facing said second focus electrode and a portion of said second focus electrode facing said first focus electrode, and a second quadrupole lens structure being formed on at least one of a portion of said third focus electrode facing said fourth focus electrode and a portion of said fourth focus electrode facing said third focus electrode, and said second quadrupole lens being formed of at least one pair of plate electrodes extending along a tube axis and facing each other across the electron beams, wherein a dynamic focus voltage varying with deflection of electron beams to a voltage higher than a voltage applied to said second focus electrode is applied to said first and third focus electrodes so that said first quadrupole lens structure produces horizontally diverging and vertically focusing actions on the electron beams and said second quadrupole lens structure produces horizontally focusing and vertically diverging actions on the electron beams, and a dynamic differential focus voltage Dv and a voltage Av applied to said accelerating electrode measured with respect to said control electrode are selected to satisfy the following inequality, $0.2 \leqq Dv/Av \leqq 4$, said dynamic differential focus voltage Dv being a voltage difference between said dynamic focus voltage when the electron beams are at the center of said phosphor screen and said dynamic focus voltage when the electron beams are deflected to a corner of a useful scanned area of said phosphor screen.

4. A color display system according to claim 3, wherein a voltage applied to said cathode is within a range of 40 to 190 V, a voltage applied to said control electrode is within a range of −80 to 50 V, said voltage applied to said accelerating electrode is within a range of 300 to 1000 V, a voltage applied to said second and third focus electrodes is within a range of 5 kV to 10 kV, a voltage applied to said anode is within a range of 22 kV to 35 kV, and a voltage applied to said first and fourth electrodes is within a range of said dynamic differential focus voltage plus said voltage applied to said second and third focus electrodes, said auxiliary electrode is connected to one of said accelerating electrode and said anode, and said range of said dynamic differential focus voltage being within a range of 200 to 2000 V.

* * * * *